US011633639B2

(12) United States Patent
Andersen

(10) Patent No.: US 11,633,639 B2
(45) Date of Patent: Apr. 25, 2023

(54) STATIONARY EXERCISE APPARATUS FOR INDOOR CYCLING

(71) Applicant: VIRTUREAL DEVELOPMENT GMBH, Harrislee (DE)

(72) Inventor: Niels Kristian Skov Andersen, Harrislee (DE)

(73) Assignee: Virtureal Development GmbH, Harrislee (DE)

( * ) Notice: Subject to any disclaimer, the term of this patent is extended or adjusted under 35 U.S.C. 154(b) by 213 days.

(21) Appl. No.: 17/122,634

(22) Filed: Dec. 15, 2020

(65) Prior Publication Data

US 2021/0205649 A1 Jul. 8, 2021

Related U.S. Application Data

(63) Continuation of application No. 15/754,127, filed as application No. PCT/EP2016/070089 on Aug. 25, 2016, now abandoned.

(30) Foreign Application Priority Data

Aug. 25, 2015 (DK) ..... PA 2015 00503

(51) Int. Cl.

| | |
|---|---|
| ***A63B 21/005*** | (2006.01) |
| ***A63B 22/00*** | (2006.01) |
| ***A63B 22/06*** | (2006.01) |
| ***A63B 24/00*** | (2006.01) |
| ***A63B 71/06*** | (2006.01) |

(Continued)

(52) U.S. Cl.

CPC ..... *A63B 21/0051* (2013.01); *A63B 21/225* (2013.01); *A63B 22/0046* (2013.01); *A63B 22/0605* (2013.01); *A63B 24/0087* (2013.01); *A63B 71/0622* (2013.01); *A63B 21/00069* (2013.01); *A63B 21/151* (2013.01); *A63B 21/157* (2013.01); *A63B 2024/0093* (2013.01); *A63B 2220/10* (2013.01); *A63B 2220/17* (2013.01); *A63B 2220/78* (2013.01); *A63B 2225/09* (2013.01); *A63B 2225/093* (2013.01)

(58) Field of Classification Search

CPC ..... A63B 21/00069; A63B 21/0054; A63B 21/151; A63B 21/157; A63B 21/225; A63B 22/0046; A63B 22/0605; A63B 24/0087; A63B 71/0622; A63B 2024/0093; A63B 2220/10; A63B 2220/17; A63B 2220/78; A63B 2225/09; A63B 2225/093

See application file for complete search history.

(56) References Cited

U.S. PATENT DOCUMENTS 3,995,491 A 12/1976 Wolfla, II
4,602,781 A 7/1986 La et al.
(Continued)

FOREIGN PATENT DOCUMENTS

WO 2008/051693 A2 5/2008

*Primary Examiner* — Joshua Lee
(74) *Attorney, Agent, or Firm* — BakerHostetler

(57) ABSTRACT

The present disclosure relates to a stationary exercise apparatus for indoor cycle training (1), i.e. a stationary exercise bicycle, preferably provided with a magnetic resistance unit (15). One embodiment relates to a stationary exercise bike comprising a flywheel (10) defining a radial gap (25) in the periphery wherein at least the periphery of the flywheel (10) has ferromagnetic properties, and wherein a magnetic resistance unit (15) is configured to controllably insert one, two or more magnets into said radial gap.

20 Claims, 11 Drawing Sheets

(51) Int. Cl.

| | |
|---|---|
| ***A63B 21/22*** | (2006.01) |
| *A63B 21/00* | (2006.01) |

(56) References Cited

U.S. PATENT DOCUMENTS

| | | | |
|---|---|---|---|
| 5,094,447 | A | 3/1992 | Wang |
| 6,695,752 | B2 | 2/2004 | Lee |
| D532,063 | S | 11/2006 | Kim et al. |
| 9,044,635 | B2 | 6/2015 | Lull |
| 10,391,348 | B2 | 8/2019 | Gibson et al. |
| 2003/0008753 | A1 | 1/2003 | Chen |
| 2003/0064863 | A1 | 4/2003 | Chen |
| 2012/0065034 | A1 | 3/2012 | Loach |
| 2016/0263415 | A1 | 9/2016 | Chen et al. |
| 2017/0106222 | A1 | 4/2017 | Mayer et al. |

STATIONARY EXERCISE APPARATUS FOR INDOOR CYCLING

CROSS-REFERENCE TO RELATED PATENT APPLICATIONS

The present application is a Continuation of application Ser. No. 15/754,127 filed Feb. 21, 2018 which is the National Stage of International Patent Application No. PCT/EP2016/070089, filed Aug. 25, 2016, which claims priority to Danish Patent Application No. PA 2015 00503, filed on Aug. 25, 2015, the disclosures of which are each incorporated herein by reference in their entirety.

FIELD OF INVENTION

The present disclosure relates to a stationary exercise apparatus for indoor cycle training, i.e. a stationary exercise bicycle, preferably provided with a magnetic resistance unit.

BACKGROUND OF INVENTION

Stationary exercise bicycles are known in the art. An exercise bike usually includes a frame for housing a rotatable element and a resistance unit, a handlebar mounted at a front end of the frame, a seat mounted at a rear end of the frame and a pair of crankarms with pedals. A display may also be provided for presenting information to the user about the ride. Exercise bicycles can be used to enhancing the performance of athletes and improve or maintain the fitness and health of non-athletes.

SUMMARY OF INVENTION

It is a challenge to simulate the feeling and flow of a normal bicycle in a stationary exercise bike, especially across a large power input from light pedalling to time trials and intensive sprints. It is furthermore a challenge to provide a precise monitoring of the power input delivered to the exercise bicycle, because that is important in order to motivate the users. And even though a stationary exercise bicycle is not exposed to varying weather conditions like a normal bicycle, a stationary exercise bike must still have a rugged design because it will typically be used by a multitude of users in sweaty and humid conditions.

In general the present disclosure relates to a stationary exercise apparatus where the rotatable element receiving and storing the rotational energy provided by the user is a flywheel. The flywheel will typically be driven by a rotatable crankshaft whereon crankarms and pedals can be mounted. In general the stationary exercise bike is preferably adapted for receiving a seat post for attaching a saddle and a head tube for attaching a handlebar. The exercise bike is preferably adapted such that the saddle position and/or the handlebar position are vertically and/or horizontally adjustable. A housing, such as a frame, may be provided for accommodating the various elements of the bike and fixing these elements relative to each other.

Flywheels are common in exercise bikes but the present inventor has realized that a flywheel with a radial gap in the periphery, preferably a centrally located radial gap, like two parallel flywheels with a gap there between, provides a number of advantages. I.e. in one embodiment the presently disclosed a stationary exercise bike comprises a lower frame housing a flywheel drivable by a rotatable crankshaft, the flywheel having a radial gap in the periphery.

A first advantage is that the gap makes it possible to insert a magnet into the gap of the flywheel. Hence, in a first embodiment of the presently disclosed exercise bike at least the periphery of the flywheel has conductive and/or ferromagnetic properties, and a magnetic resistance unit is configured to controllably insert one, two or more magnets into said radial gap in the flywheel. This has turned out to be a very efficient solution for providing a magnetic resistance of a flywheel and makes it possible to design a very slim frame for the exercise bike.

A second advantage of a radial gap is that the flywheel can be belt or chain driven centrally through this radial gap. Hence, in a further embodiment of the presently disclosed exercise bike the flywheel comprises a first driving wheel and the radial gap is extending to the first driving wheel. A driving unit having a second driving wheel can then be displaced from and parallel to the first driving wheel, and a driving element can further be provided to connect the first and second driving wheels through the radial gap in the flywheel. In that way the flywheel can be driven centrally, e.g. at the axis of the centre of mass of the flywheel.

A further aspect of the present disclosure relates to a freewheeling arrangement of the stationary exercise bike. All road racing bike and mountain bikes are provided with freewheeling mechanisms in the rear wheel. I.e. bicycle riders are used to riding with a freewheeling arrangement but that is not normal in a stationary exercise bike. However, in order to more closely resemble the feeling and flow of a real bicycle on a stationary exercise bicycle, a freewheeling arrangement is highly desired but that can be difficult to implement in a flywheel setup. But the present inventor has realized that a freewheeling arrangement can be incorporated in the crank shaft. Hence, a further embodiment relates to a stationary exercise bike comprising a flywheel, a driving unit having a crank shaft mounted in a freewheeling mechanism, and a driving element connecting the flywheel and the freewheel crank shaft, such that the exercise bicycle can be driven in a freewheel arrangement.

Yet a further aspect relates to the flexibility of stationary exercise bikes. There are huge geometrical differences between racing bikes, time-trial bikes, triathlon bikes, mountain bikes, city bikes, spinning bikes and "traditional" stationary exercise bikes. The presently disclosed stationary exercise bicycle in a further embodiment deals with this issue by providing a separate lower frame for housing the rotatable element (e.g. a flywheel), crankarms with pedals and the resistance unit. On this lower frame an upper frame can be mounted housing the seat post & seat and head tube & handlebar. The advantage is that several different upper frames can be designed, each design having different geometrical setup targeted for different applications. E.g. for racing bike application the seat post and head tube can be provided with the angles and heights typically used in racing bikes where the handlebar can be far away and below the seat, whereas for traditional exercise bikes for the handlebar is closer to and higher than the seat for a more upright position on the bike. One example of separate lower and upper frames of a stationary exercise bike is illustrated in FIGS. 1 and 2.

DESCRIPTION OF DRAWINGS

The present invention will be described in more detail in the following with reference to these exemplary drawings.

DETAILED DESCRIPTION OF THE INVENTION

Figure 1:
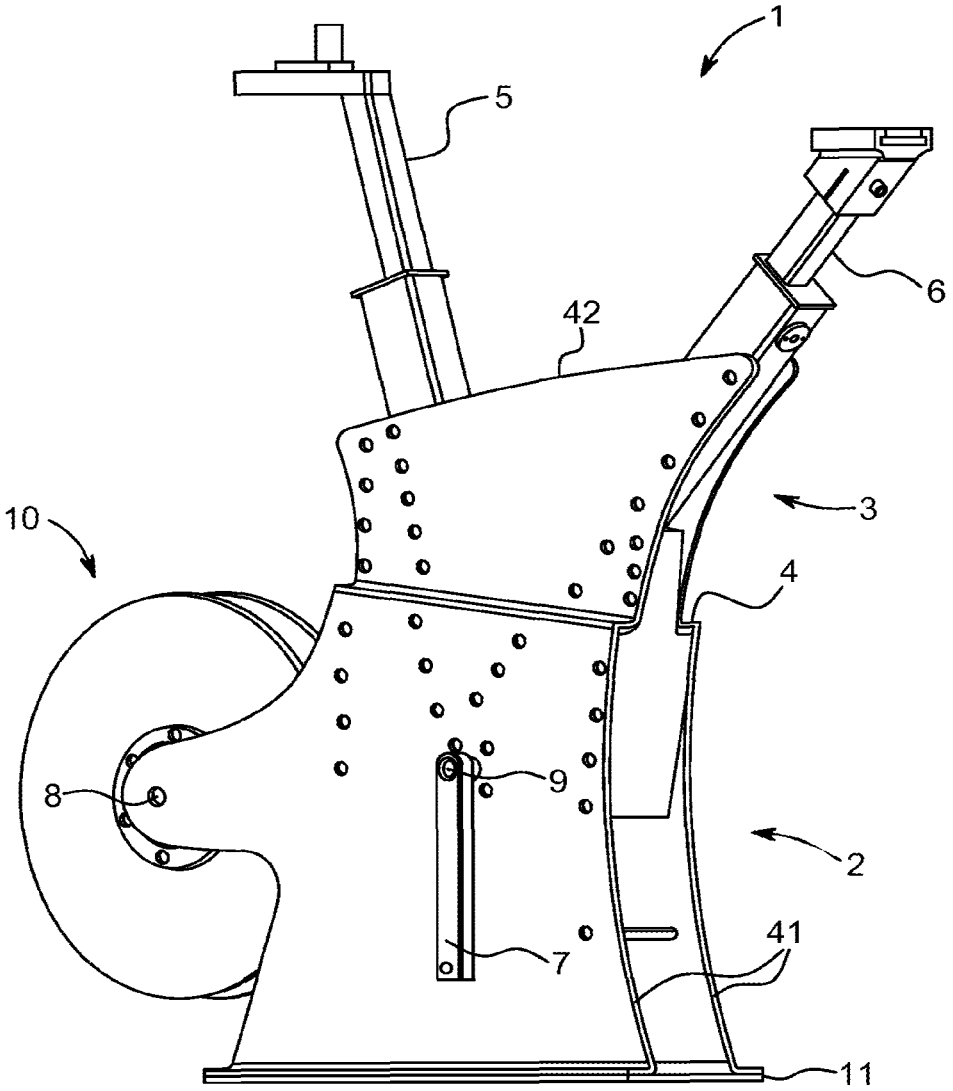
FIG. 1 shows an embodiment of the presently disclosed stationary exercise bike.

As stated above one embodiment of the present disclosure relates to a stationary exercise bike comprising a flywheel, the flywheel preferably having a radial gap in the periphery. For example a stationary exercise bike comprising lower frame housing a flywheel drivable by a rotatable crankshaft, the flywheel having a radial gap in the periphery. The flywheel may be formed by two parallel plates, such as metallic plates, preferably aluminium plates, mounted on a flywheel shaft with a distance there between thereby forming the radial gap between the plates.

In a normal bicycle wheel a large part of the weight is located near the periphery due to the rim and the tire. To more closely resemble the feeling of a bicycle wheel the present flywheel may be provided with added weight near the periphery. E.g. in the form of one or more rings attached to the side of the flywheel near the periphery. In the case of two parallel plates of the flywheel each plate may have a peripheral ring located on the inside or outside of the side surface of the flywheel plates. Hence, the peripheral ring(s) do(es) not increase the diameter of the flywheel but serves to increase the weight of the periphery of the flywheel. However, alternatively one or more rings can be mounted radially on the flywheel in a heavier material to increase the weight of the flywheel near the periphery, thereby increasing the diameter of the flywheel and the weight of the periphery of the flywheel. This radial ring may then be provided with a radial gap.

The braking/resistance system applied herein is preferably a magnetic resistance system. If at least the outer periphery of the flywheel is conductive a rotation of the flywheel inside a magnetic field will induce electric currents in the conductive which generate a magnetic field in opposition to the original field thus creating a force which acts to decelerate the rotating flywheel. The braking system therefore retards motion or causes deceleration of the flywheel by converting the kinetic energy of the flywheel to heat without actually contacting the flywheel 32. At least a part of the flywheel is therefore preferably made from a conductive material such as aluminium, steel, copper, gold, silver and the like so as to be capable of generating internal electric currents. Further advantages can be provided if at least a part of the flywheel, preferably at least a part of the flywheel is provided in a ferromagnetic material, such as an appropriately selected steel alloy.

A further advantage of one or more rings when using a magnetic resistance unit is that the flywheel can be provided in a substantially less conductive and/or ferromagnetic and lightweight material like aluminium and the ring(s) can be provided in a more conductive and/or ferromagnetic material. Hence, said one or more rings may be provided in a material with (good) conductive and/or ferromagnetic properties, such as steel.

When using a strong permanent magnet in a magnetic resistance unit it has been realized that the rings advantageously can be attached on the outside of the flywheel plates such that the width of the flywheel separates the magnet (located in the gap) from the rings.

The one or more magnets used in the magnetic resistance unit may preferably be permanent magnets, preferably selected from the group of rare-earth magnets, preferably neodymium magnets.

Figure 3:
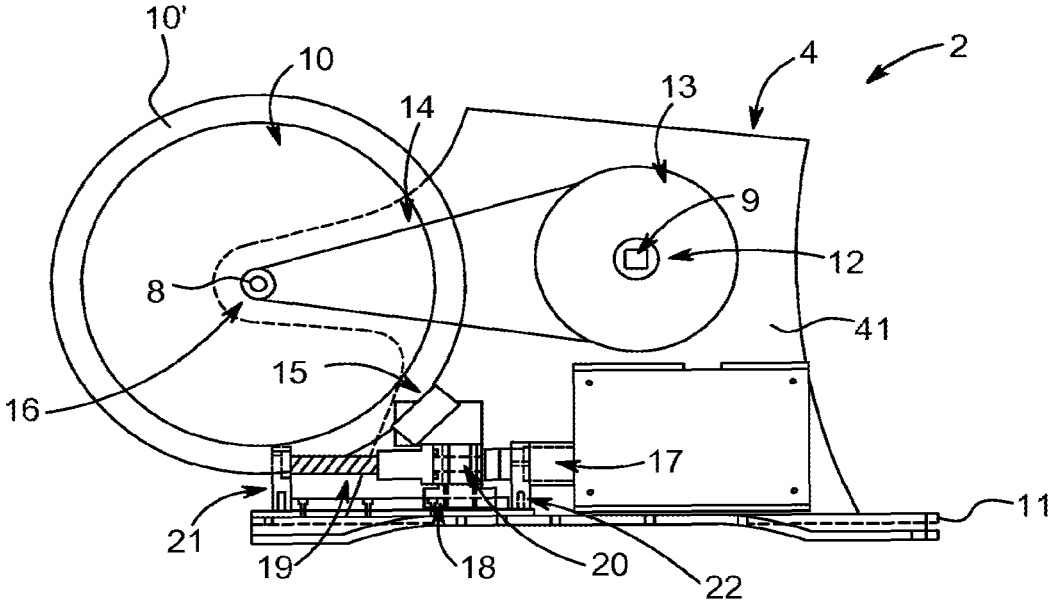
FIG. 3 shows a schematic overview of the exercise bike in FIG. 1.
Figure 5:
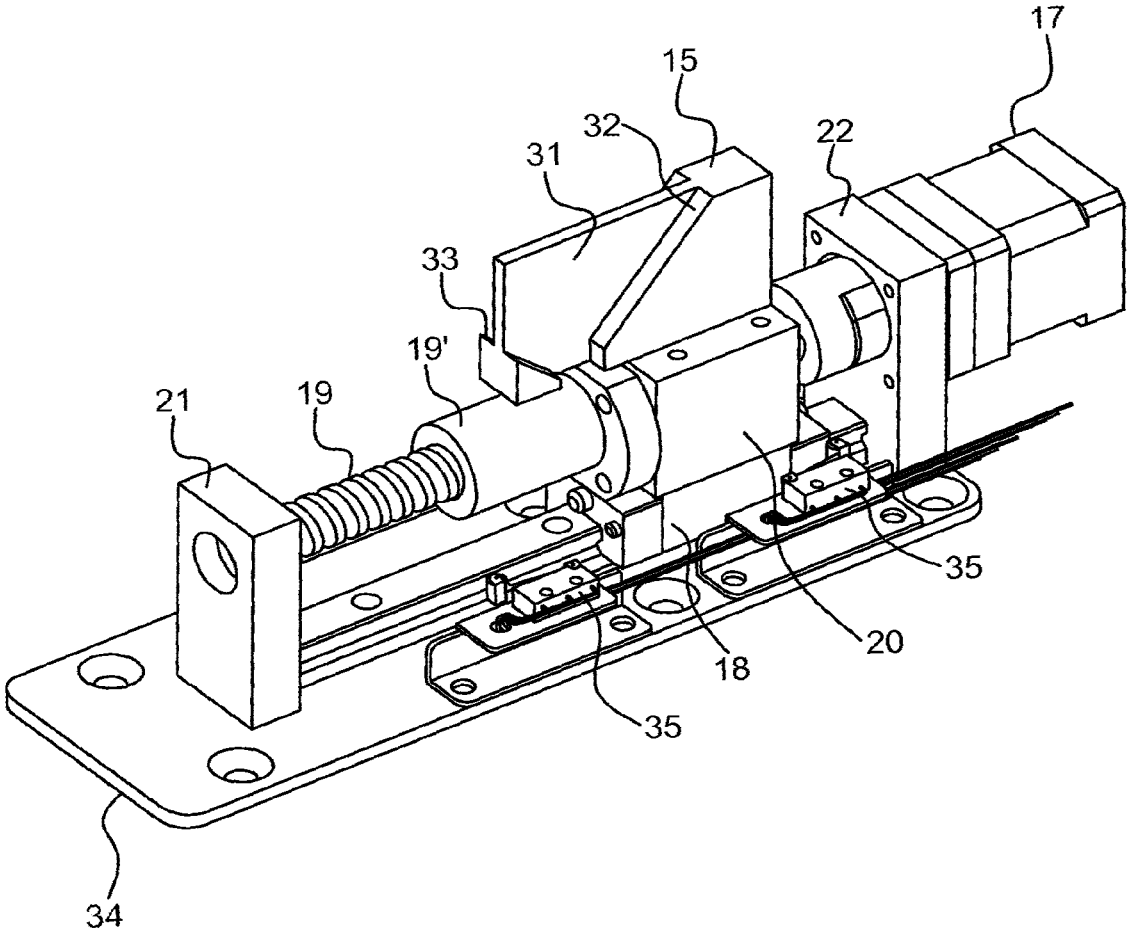
FIG. 5 shows an example of a magnetic resistance unit of the exercise bike in FIG. 1.
Figure 6A:
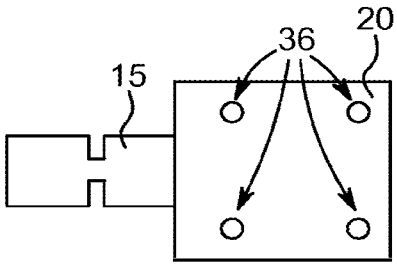
FIG. 6A shows an exemplary illustration of a magnet holder of the exercise bike of FIG. 1.
Figure 6B:
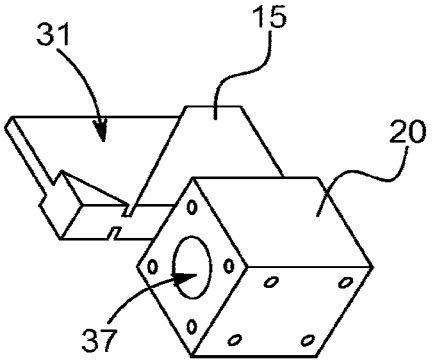
FIG. 6B shows another exemplary illustration of the magnet holder.
Figure 6C:
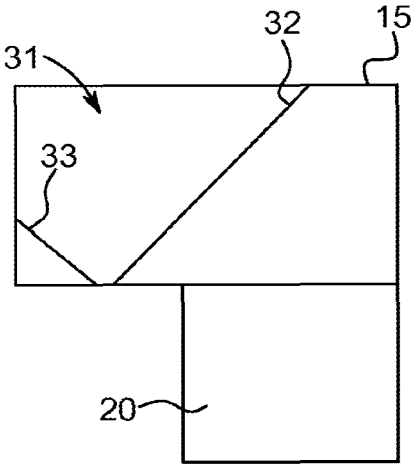
FIG. 6C shows another exemplary illustration of the magnet holder.
Figure 6D:
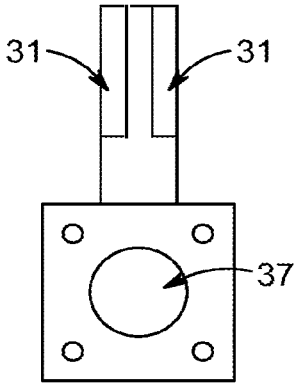
FIG. 6D shows another exemplary illustration of the magnet holder.
Figure 7:
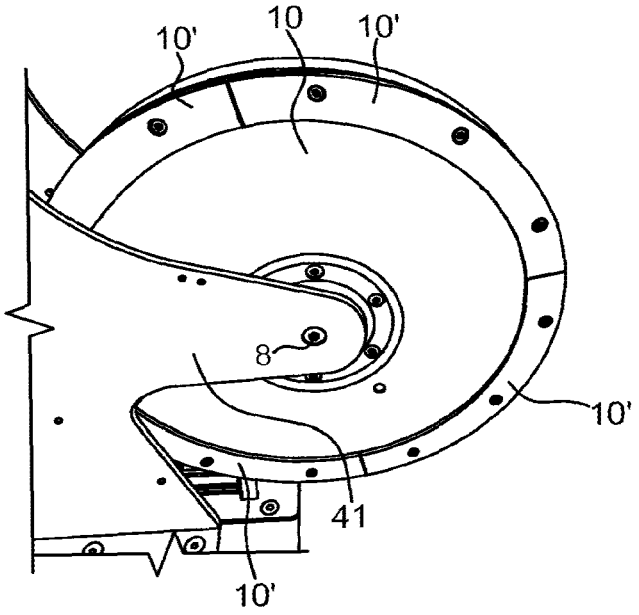
FIG. 7 shows a close-up of the flywheel of the exercise bike on FIG. 1.
Figure 8A:
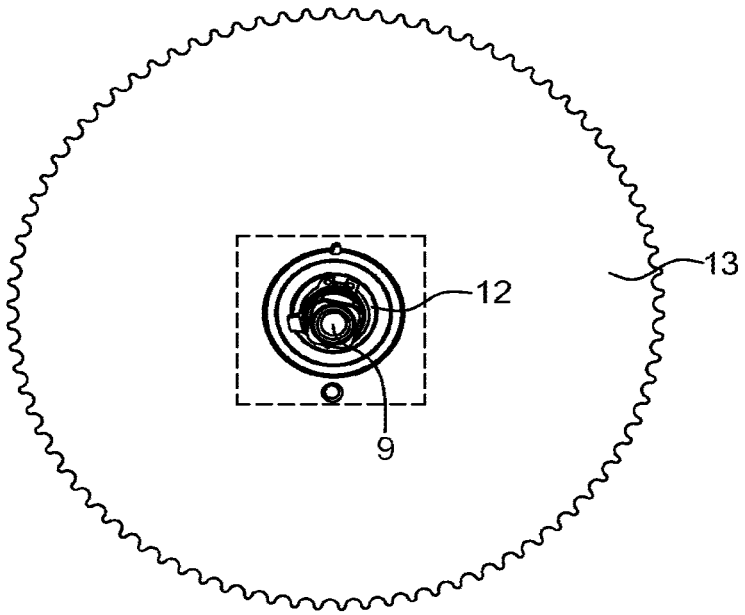
FIG. 8A shows a close-up of the front drive element having a freewheel bearing which is part of the exercise bike in FIG. 1.
Figure 8B:
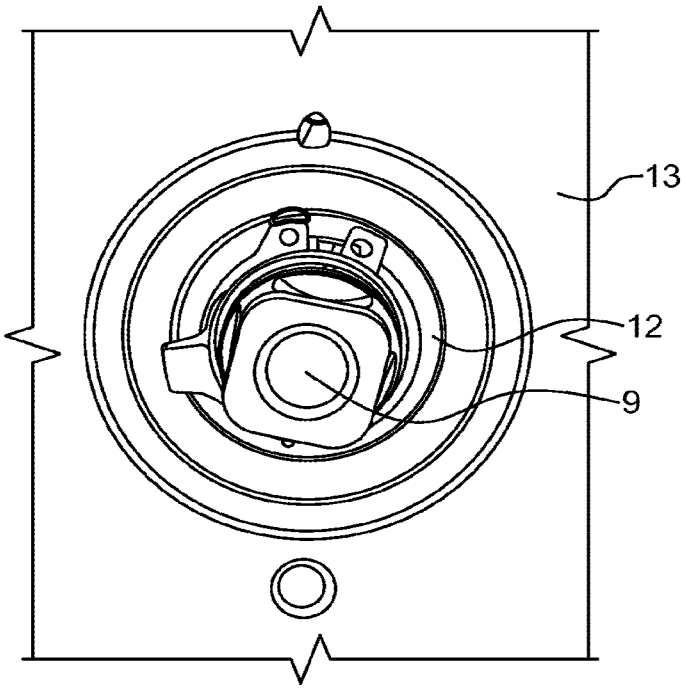
FIG. 8B shows another close-up of the front drive element having the freewheel bearing.

In a preferred embodiment the magnetic resistance unit comprises a motor, such as a DC motor such as a step motor, a threaded guide bolt, a slide seat and a magnet holder for holding said magnet(s). These elements can be assembled and arranged such that the magnet holder can be translated inside the radial gap of the flywheel in a linear fashion controlled by the step motor as also exemplified in FIGS. 3 and 5. The advantage of using a step motor is that very small and very precise steps can be provided for controlling the position of the magnet relative to the flywheel thereby obtaining a very reproducible setting of the magnetic resistance. The step motor and the magnetic resistance unit are preferably configured to provide micro-steps, such that each step of the step motor corresponds to less than 0.05 mm, more preferably 0.04 mm, most preferably less than 0.03 mm of linear translation of the magnet holder. This may be provided by allowing a linear translation of for example 45 mm over at least 1000 steps, preferably at least 1500 steps of the step motor.

In the magnet holder it can be utilized that magnets strongly attract each other. In one embodiment the magnet holder comprises two contact surfaces on opposite sides of a plate, each contact surface formed to hold a predefined permanent magnet, the plate formed such that the permanent magnets attract each other when mounted in the magnet holder. This is exemplified in FIGS. 5 and 6A-D.

As stated previously an advantage of a radial gap in the flywheel is that the flywheel can be driven centrally, e.g. at the axis of the centre of mass of the flywheel. A flywheel can also be driven centrally if the bicycle crank and crankarms are mounted directly on the flywheel. However, that limits the rotation of the flywheel to the pedalling rotation of the user. When using a magnetic resistance unit the resistance exerted on the flywheel at least partly depends on the rotational speed of the flywheel. Hence, a larger resistance can be obtained with the same magnet if the rotational speed of the flywheel is higher. It is therefore an advantage to provide first and second driving wheels connected by a driving element because that enables a gearing of the flywheel which can significantly increase the rotational speed of the flywheel. In the presently disclosed stationary exercise bicycle a gearing between the first driving wheel and the second driving wheel may be at least 3, preferably at least 4, more preferably at least 5. This may be provided by having a first driving toothed wheel with 10-20 teeth, preferably 13-18 teeth, such as 16 teeth, depending on the application. A second driving toothed wheel may then have between 60-110 teeth, preferable 70-100, more preferably 80-90 teeth, such as 88 teeth.

As stated previously a freewheeling mechanism can advantageously be incorporated in the crank shaft mounted in a freewheeling mechanism such that the exercise bicycle can be driven in a freewheel arrangement. A freewheeling mechanism could be incorporated in the flywheel but in order to sustain the power of a flywheel the freewheel mechanism would have to be quite large in diameter. A toothed wheel mounted on the freewheel mechanism would the necessarily have at least 25 or more teeth. This would then reduce the available gearing of the exercise bike, because the crank driving wheel would need 125 or more teeth to have a gearing of 5 thereby making the exercise bicycle larger. By having the freewheel mechanism in the crank shaft the flywheel driving wheel can be made much smaller and the gearing of the exercise bike correspondingly larger.

The presently disclosed bicycle can be housed in a frame formed by plates, e.g. rigid side plates, bottom and top plates, such as 5-10 mm thick metallic plates in for example aluminium or steel. As stated previously the exercise bicycle may have separate upper and lower frames which are separable such that different types of upper frames can be mounted on the same lower frame.

A number of rigid support elements, such as 2, 3, 4 or at least 5 support elements, preferably elongated and metallic, e.g. aluminium or steel, may be provided in the presently disclosed stationary exercise bikes for providing a more rigid and stable construction. The support elements may extend between the upper and lower frames as illustrated in FIGS. 4A-E, firmly attached to both the lower frame and the upper frame, preferably attached to the side plates of the upper and lower frames. The width of the support elements preferably matches the inner width of the upper and lower frames, respectively.

Athletes from elite to recreational athletes are increasingly interested in receiving information about their physiological wellbeing. One parameter is the power delivered by the user when operating the exercise bicycle. Many exercise bicycles measure the output in real-time during exercise but that provides a relatively large uncertainty and the measuring equipment can be rather complicated and expensive. However, as also disclosed in WO 2008/051693 the power is depending on the RPM of the flywheel and the position of the magnet. These two parameters can be measured in advance to provide a "map" of RPM vs. magnet position. In the presently disclosed exercise bike the RPM of the flywheel can be measured standardly by an RPM monitor and the position of the magnet can be very precisely determined by the step motor. A very detailed map of flywheel RPM vs. step motor position (0-1550) can be determined in advance by fitting a motor with known and calibrated output power to the crank shaft. I.e. the presently disclosed stationary exercise bicycle can be "calibrated" in advance such that the wattage can be provided to the user at any RPM and any setting of the magnetic resistance unit. With a magnetic resistance unit the wear and tear will be neglectable providing a rugged and precise solution where the wattage can be displayed to the user in a display, stored in a computer or the like. RPM of the crankshaft can also be provided, both for providing the pedalling frequency to the user but also for monitoring when the user is not pedalling such that this can be accounted for in the calculated energy consumption of the user.

The precise correspondence between wattage, RPM and resistance can also be utilized to simulate a real cycling situation to the user. If the user's height and weight is known the drag from the wind and the resistance from gravity and rolling can be calculated such that the necessary wattage to drive a given geographical route can be determined. The presently disclosed exercise bicycle can then be configured to any real life situation driving in wind, uphill, downhill, etc.—all that is necessary is the user's weight and height and the route. A processing unit, controller and/or display, can then be provided to continuously monitor and control the exercise bike and the user can thus be part of real historical road races comparing, and possibly visualizing, to actual cyclists, or several users can virtually ride together and compete against each other.

Example

Figure 2:
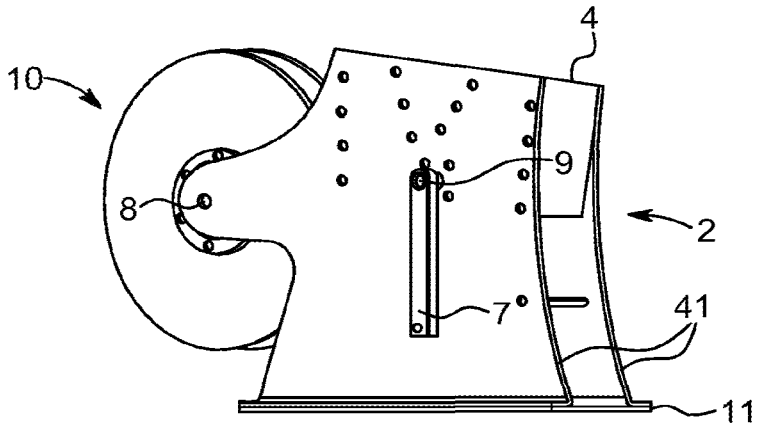
FIG. 2 shows the lower frame only of the exercise bike in FIG. 1.

An exemplary stationary exercise bicycle 1 is illustrated in the drawings. The bike 1 comprises a lower frame 2 housing the flywheel 10 rotating on the flywheel shaft 8 and the crankshaft 9 having crankarms 7 thereon. The lower frame 2 rests on the bottom plateau 11. Attached to the separate lower frame 2 is the upper frame 3 housing the height adjustable seat tube 5 whereon a saddle can be mounted and the height adjustable head tube 6 whereon handlebars can be mounted. The lower frame 2 and the upper frame 3 can be separated at the point 4 as seen in FIG. 2 where the lower frame 2 is separately illustrated.

The flywheel 10 is formed by two parallel aluminium plates mounted on a flange 23 forming a radial gap 25 therebetween which is 40 mm wide. The diameter of the flywheel is 390 mm. The gap 25 between the plates makes it possible to have a toothed wheel with 16 teeth on the flywheel shaft centrally between the plates. The two parallel plates of the flywheel 10 are mounted on a flange 23 attached to the bearing 24 on the flywheel shaft 8.

Steel elements 10' are attached to the outside side surface of the near the periphery of the flywheel 10 to form steel rings 10' that increases the weight of the periphery of the flywheel 10 and improves the ferromagnetic properties of the periphery of the flywheel 10. Each steel ring 10' measures 30 mm in height and 5 mm in width.

The flywheel 10 is driven by the front toothed wheel 13 having 88 teeth via belt drive 14 providing a gearing of the flywheel of 5.5. The front toothed wheel 13 is mounted on the crankshaft 9 by means of a freewheel bearing 12. The toothed wheels 13 and 16 are connected by the belt drive 14.

The crank shaft 9 are mounted via a normal bearing 26 and with a freewheel mechanism 25 located centrally. The freewheel mechanism 25 on the crankshaft 9 provides a freewheel feeling like a road racing bike to the user. If the user is pedalling thereby rotating the freewheel 10 and subsequently stops pedalling, the freewheel 10 will keep rotating and drive the belt 14 and thereby rotate the front toothed wheel 13. However, the freewheel mechanism 12 ensures that the crankshaft 9 and the crankarms 7 do not rotate. Likewise the freewheel mechanism 12 ensures that backwards pedalling is freewheel whereas forward pedalling rotates the flywheel 10.

The magnetic resistance unit is mounted on the bottom plateau 11 between two vertical walls 21, 22. The resistance unit comprises a stepper motor 17 oriented such that the axis of rotation is parallel to the bottom plateau 11, a threaded bolt 19, a sliding seat 18, and a magnet holder 15 mounted on the sliding seat 18. This configuration ensures that the magnet holder 15 moves linearly relative to the bottom plateau 11 and thereby linearly relative to the rotation axis 8 of the flywheel 10. Controllers 35 define the travelling interval of the sliding seat 18. The solid bottom plate 34 of the magnetic resistance unit is mounted on the bottom plateau 11 of the exercise bicycle. The stepper motor has more than 1500 steps to move the sliding seat 18 a linear distance of 45 mm giving a step length of less than 0.03 mm.

The magnet holder is attached to the block 20 having a through hole 37 for the threaded bolt 19. A screw thread is provided in the element 19' attached to the block 20 by means of screw holes 36. The magnet holder 15 comprises two contact surfaces 31, each surface adapted to receive a permanent magnet in the form of a rectangular neodymium magnet (not shown) measuring 30×60 mm and 15 mm in thickness. The contact surfaces 31 are defined by angled edges 32 and 33 forming a 90 degree corner for receiving the magnets. The plate forming the contact surfaces 31 is 4 mm thick aluminium. The magnets will attach to each side of the magnet holder and will magnetically attract each other to be attached very tight. The angle of the edges 32 and 33 is approx. 45 degree, preferably between 42 and 47 degrees, relative to the horizontal bottom plate 34 such that the edge 33 points substantially radially towards the flywheel 10. The lower edge 33 helps to prevent the magnets from being torn off by the magnetic field generated by the flywheel and the magnets during rotation. With two 15 mm magnets attached to the contact surface 31 having a thickness of 4 mm the resulting magnetic "brake" will have a total thickness of 34 mm thereby being suitable for the 40 mm radial gap 25 in the flywheel 10 providing a spacing of 3 mm between the magnets and the flywheel. The aluminium flywheel plates further separates the magnets from the ferromagnetic steel elements 10'.

The lower frame 2 and upper frame 3 are manufactured in metal and/or plastic and is provided in a wall thickness of 5-10 mm. The side plates 41, 42 are preferably provided in aluminium whereas the bottom plate 11 is preferably steel. The slim design provides an exercise bicycle with an outside width of the lower frame 2 of only 95 mm. The upper frame can be made as thin as 50 mm in outer width.

The support elements 51, 55 provide stiffness and rigidity to the constructions and are seen in FIG. 4A and FIGS. 9A-D. The two outermost support elements 51 extend primarily vertically between the upper 3 and lower frames 2, whereas the two central support elements 55 are provided to be substantially parallel with the seat post and the head tube, respectively, for better supporting the weight from the user sitting on a saddle (not shown) and leaning on the handle bar (not shown). As stated previously the upper and lower frames 3, 2 may in one embodiment be separable. This can be provided by loosening the central support elements 55 in the lower frame 2 (by removing the corresponding screws) and loosening the outermost support element 51 in the upper frame 3. The upper frame 3, including the central support elements 55, can then be lifted and separated from the lower frame 2 and the outer support elements 51 and another upper frame, possibly with different geometry of the seat post and the head tube, can be mounted on the lower frame 2 by attaching the support elements extending from the new upper frame to the lower frame 2.

Figure 4A:
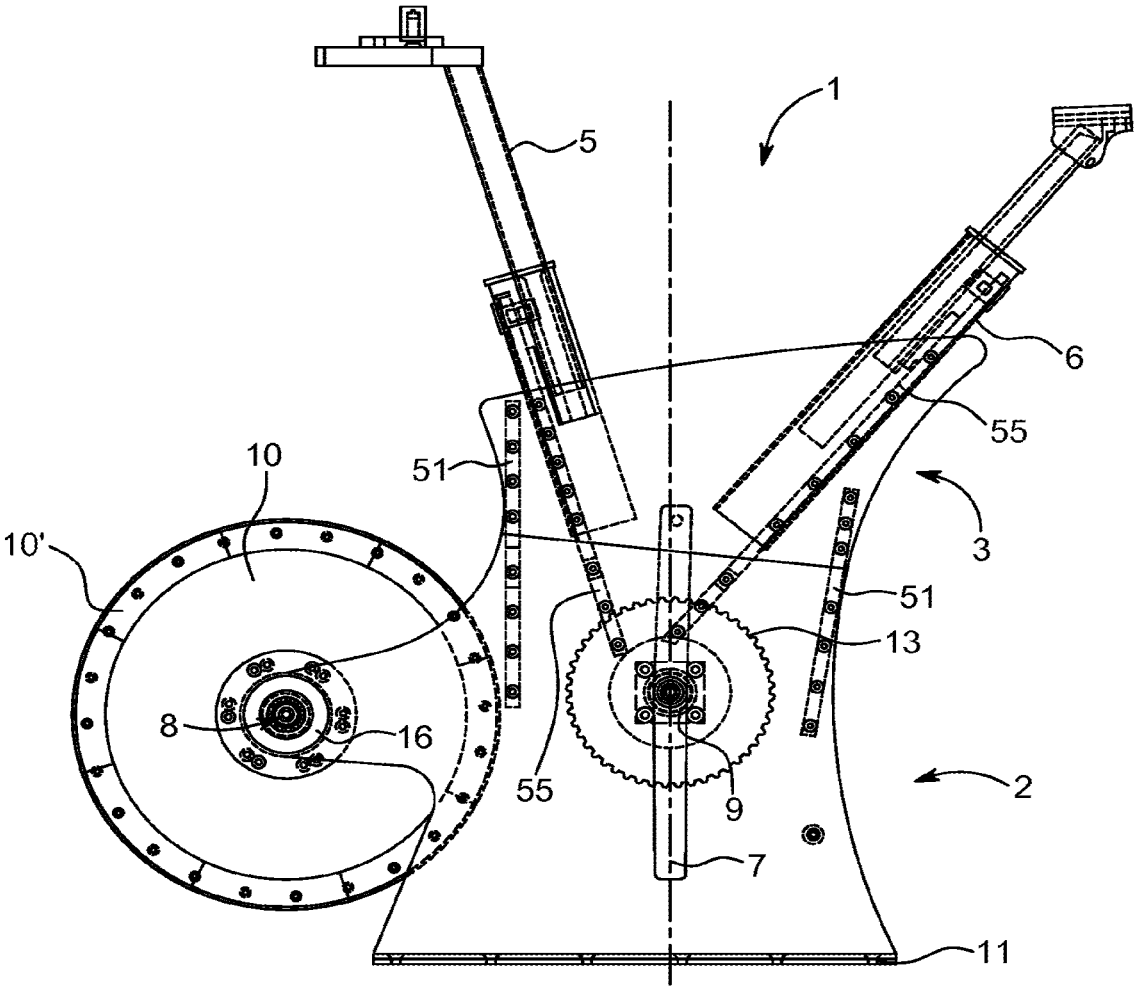
FIG. 4A shows an exemplary illustration of the exercise bike from the side.
Figure 4B:
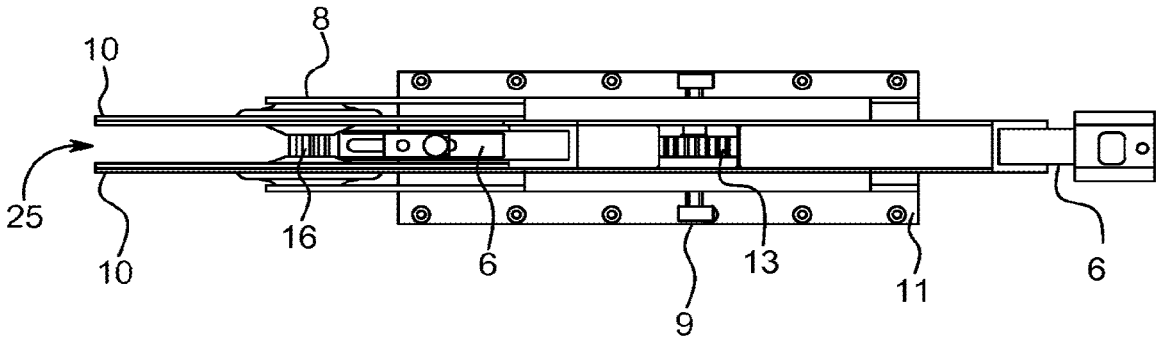
FIG. 4B shows an exemplary illustration of the exercise bike from below.
Figure 4C:
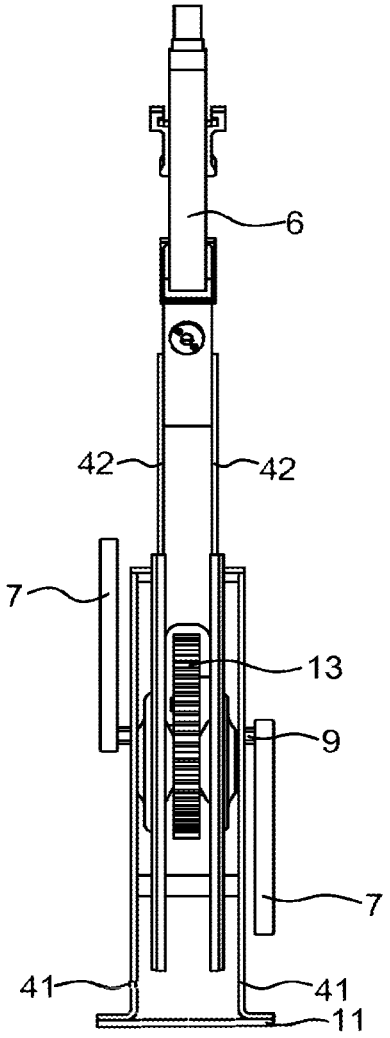
FIG. 4C shows an exemplary illustration of the exercise bike from above.
Figure 4D:
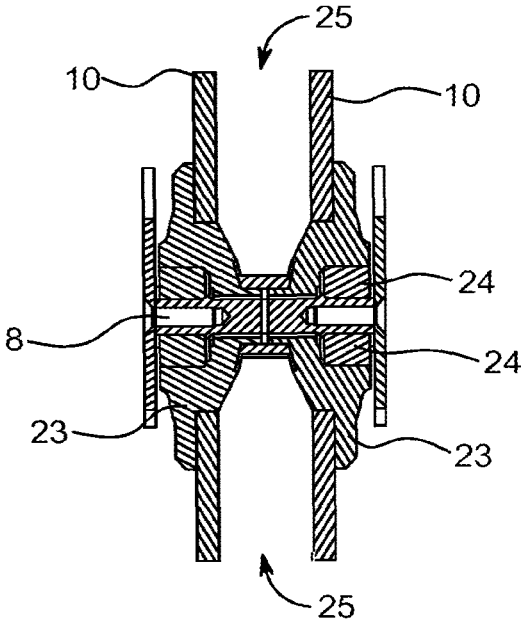
FIG. 4D shows an exemplary illustration of the centre of the flywheel shaft.
Figure 4E:
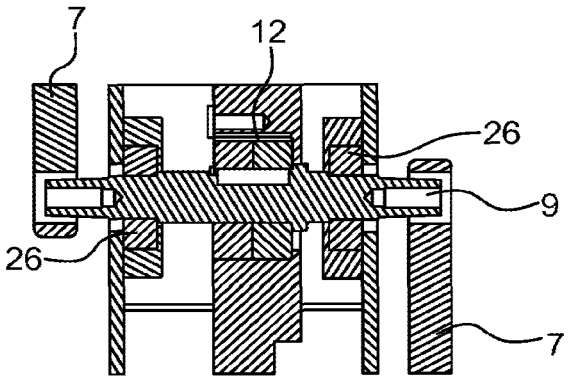
FIG. 4E shows an exemplary illustration of the centre of the crank shaft.
Figure 9A:
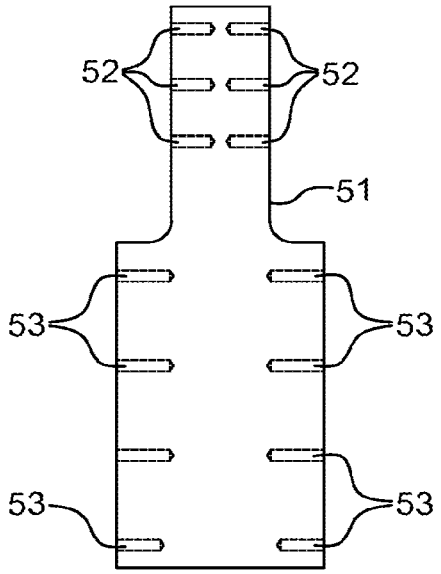
FIG. 9A shows a view of an exemplary support element connecting the lower and upper frame of the bike in FIG. 1.
Figure 9B:
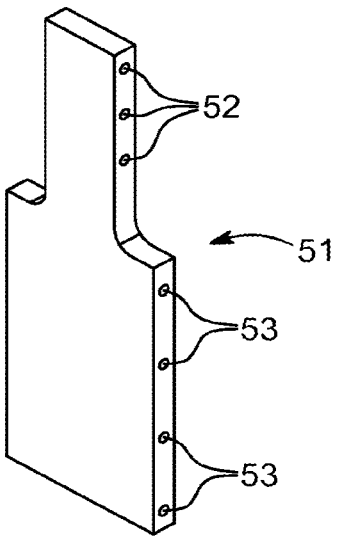
FIG. 9B shows another view of the exemplary support element of FIG. 9A.
Figure 9C:
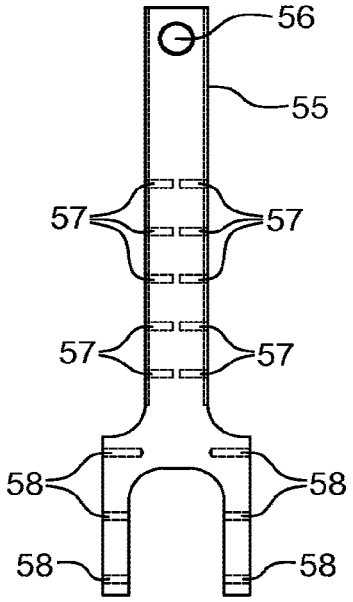
FIG. 9C shows a view of another exemplary support element connecting the lower and upper frame of the bike in FIG. 1.
Figure 9D:
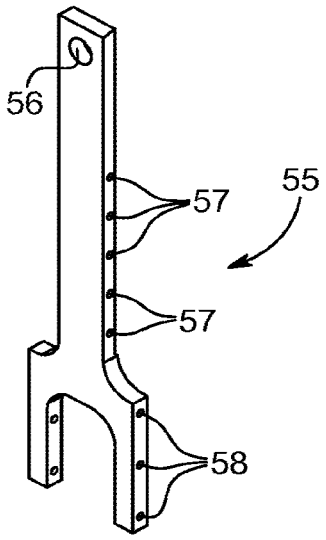
FIG. 9D shows another view of the exemplary support element of FIG. 9C.

As illustrated in FIGS. 9A-D the support elements 51, 55 may be wider in the lower end than the upper end to match the different inner widths of the upper 3 and lower frames 2. The support elements 51, 55 are preferably provided in 12 mm steel. Threaded screw holes 52, 53, 57, 58 are provided in the sides of the support elements 51, 55 to allow for attachment with the side plates 41, 41 of the upper and lower frames 3, 2. As seen in FIG. 9D the central support elements 55 may be formed as a fork in the lower end to allow for passage of the front driving wheel as also illustrated in FIG. 4A. A hole 56 may be provided in the upper end of the central support elements 55 to allow for the throughgoing bolt for the seat post height adjuster and the handle bar height adjuster, respectively, as also seen in FIG. 4A.

The exemplary exercise bike 1 illustrated in the drawings is provided with a geometry of the seat post and the head tube corresponding to a racing bike. A different geometry can be provided by mounting another upper frame 2. Holes for the screws for the support elements 51, 55 are visible in FIGS. 1 and 2. Another upper frame with a different geometry of the seat post and the head tube would only require an additional set of holes (not shown) in the lower frame 2 which would then be configured for also engaging with this specific type of upper frame.

The invention claimed is:

1. A stationary exercise bike comprising: a lower frame housing a flywheel drivable by a rotatable crankshaft, wherein the flywheel comprises two parallel plates mounted in parallel on a flywheel shaft with a distance there between thereby forming a radial gap, and wherein each parallel plate comprises one or more rings mounted near a periphery of the parallel plates, and wherein the one or more rings have at least one of conductive or ferromagnetic properties.

2. The stationary exercise bike according to claim 1, wherein at least a periphery of the flywheel has one or more of conductive or ferromagnetic properties, and wherein a magnetic resistance unit is configured to controllably insert one or more magnets into the radial gap.

3. The stationary exercise bike according to claim 1, wherein the two parallel plates are metallic plates.

4. The stationary exercise bike according to claim 1, wherein the one or more rings comprise a material with ferromagnetic properties.

5. The stationary exercise bike according to claim 4, wherein the one or more rings are comprised of steel.

6. The stationary exercise bike according to claim 1, wherein the one or more rings have stronger ferromagnetic properties than the parallel plates.

7. The stationary exercise bike according to claim 1, wherein each of the parallel plates has a width and an outside facing away from the radial gap, wherein the one or more rings are attached on each outside and, wherein one or more magnets is positioned in the gap such that the width separates the one or more magnets from the one or more rings.

8. The stationary exercise bike according to claim 7, wherein the one or more magnets are permanent magnets.

9. The stationary exercise bike according to claim 8, wherein the permanent magnets are rare-earth magnets.

10. The stationary exercise bike according to claim 8, wherein the permanent magnets are neodymium magnets.

11. The stationary exercise bike according to claim 1, wherein the flywheel comprises a first driving wheel, and wherein the radial gap is located centrally in the periphery of the flywheel and extends to the first driving wheel, the stationary exercise bike further comprising:

a pedaling unit having a second driving wheel displaced from and parallel to the first driving wheel; and a driving element connecting the first and second driving wheels through the radial gap in the flywheel.

12. The stationary exercise bike according to claim 11, wherein the first driving wheel has between 10-20 teeth and the second driving wheel has between 60-110 teeth for providing a gearing between the first driving wheel and the second driving wheel that is one or more of at least 3, at least 4, or at least 5.

13. The stationary exercise bike according to claim 11, wherein the first driving wheel is a gearwheel or the second driving wheel is a gearwheel.

14. The stationary exercise bike according to claim 11, wherein the driving element is an endless belt.

15. The stationary exercise bike according to claim 14, further comprising a magnet holder comprising two contact surfaces on opposite sides of a plate, each contact surface formed to hold a predefined permanent magnet, the plate formed such that the permanent magnets attract each other when mounted in the magnet holder.

16. The stationary exercise bike according to claim 15, further comprising a magnetic resistance unit configured to controllably insert one or more magnets into the radial gap and a step motor, wherein the step motor and the magnetic resistance unit are configured such that each step of the step motor corresponds to less than 0.05 mm, 0.04 mm, or 0.03 mm of linear translation of the magnet holder.

17. The stationary exercise bike according to claim 1, further comprising:

a pedaling unit wherein the crankshaft is mounted in a freewheeling mechanism; and a driving element connecting the flywheel and the crankshaft such that the crankshaft is separated from the flywheel shaft, such that the flywheel can be driven in a freewheel arrangement where the freewheeling mechanism is provided in the crankshaft by a freewheel bearing between a front toothed wheel and the crankshaft.

18. The stationary exercise bike according to claim 1, further comprising an upper frame comprising a seat post for attaching a saddle and a head tube for attaching a handlebar, wherein the upper frame is detachable from the lower frame such that different types of upper frames with different configurations of the seat post and head tube can be attached to the lower frame.

19. The stationary exercise bike according to claim 1, wherein the two parallel plates are aluminum plates.

20. A stationary exercise bike comprising: a lower frame housing a flywheel drivable by a rotatable crankshaft, the flywheel having a radial gap between outer surfaces of the flywheel, wherein at least a periphery of the flywheel has conductive or ferromagnetic properties, and wherein a magnetic resistance unit is configured to controllably insert one or more magnets into the radial gap, wherein the magnetic resistance unit comprises a stepper motor, a threaded guide bolt, a slide seat, and a magnet holder for holding the one or more magnets, such that the magnet holder can be translated inside the radial gap of the flywheel in a linear fashion.

* * * * *